US011273486B2

(12) United States Patent
Huang et al.

(10) Patent No.: US 11,273,486 B2
(45) Date of Patent: Mar. 15, 2022

(54) MULTI-STAGE FORGING PROCESS

(71) Applicant: KARSTEN MANUFACTURING CORPORATION, Phoenix, AZ (US)

(72) Inventors: Yujen Huang, Pingtung (TW); Erik M. Henrikson, Phoenix, AZ (US); Matthew W. Simone, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 223 days.

(21) Appl. No.: 16/573,938

(22) Filed: Sep. 17, 2019

(65) Prior Publication Data

US 2020/0086379 A1 Mar. 19, 2020

Related U.S. Application Data

(60) Provisional application No. 62/732,438, filed on Sep. 17, 2018.

(51) Int. Cl.

| | |
|---|---|
| ***B21K 17/00*** | (2006.01) |
| ***B21J 9/02*** | (2006.01) |
| *A63B 53/04* | (2015.01) |

(52) U.S. Cl.

CPC ..... *B21K 17/00* (2013.01); *B21J 9/022* (2013.01); *A63B 53/0412* (2020.08); *A63B 53/0475* (2013.01)

(58) Field of Classification Search

CPC ..... B21K 17/00; B21J 9/022

See application file for complete search history.

(56) References Cited

U.S. PATENT DOCUMENTS

| | | | | |
|---|---|---|---|---|
| 1,673,994 | A | 6/1928 | Williams | |
| 6,030,295 | A | 2/2000 | Takeda | |
| 6,083,118 | A | 7/2000 | Martins et al. | |
| 6,267,690 | B1 | 7/2001 | Salmon | |
| 6,666,779 | B1 | 12/2003 | Iwata et al. | |
| 7,976,403 | B2 | 7/2011 | Gilbert et al. | |
| 7,980,960 | B2 | 7/2011 | Gilbert et al. | |
| 8,206,237 | B2 | 6/2012 | Gilbert et al. | |
| 8,388,464 | B2 | 3/2013 | Gilbert et al. | |
| 8,668,598 | B2 | 3/2014 | Gilbert et al. | |
| 9,101,974 | B2 | 8/2015 | Liang et al. | |
| 2002/0016218 | A1* | 2/2002 | Takeda | A63B 53/04 473/324 |

(Continued)

FOREIGN PATENT DOCUMENTS

| | | |
|---|---|---|
| CN | 100469407 | 9/2009 |
| JP | 10314347 | 12/1998 |

OTHER PUBLICATIONS

International Search Report / Written Opinion from PCT Application No. PCT/US2019/051587, dated Dec. 4, 2019.

*Primary Examiner* — Sarang Afzali

(57) ABSTRACT

A method of manufacturing a forged iron type golf club head with a cavity. The method of manufacturing comprises forming a billet into an intermediate club head body with a strike face comprising an upper region and a lower region; hot pressing a cavity into the rear portion of the intermediate body; and bending the strike face of the intermediate club head body to form a golf club head with a cavity and a planar strike face. Other embodiments are disclosed.

20 Claims, 5 Drawing Sheets

(56) References Cited

U.S. PATENT DOCUMENTS

| | | | | |
|---|---|---|---|---|
| 2002/0095762 | A1* | 7/2002 | Takeda | A63B 60/00 29/447 |
| 2005/0233825 | A1 | 10/2005 | Tsai | |
| 2006/0094532 | A1 | 5/2006 | Seeley | |
| 2006/0196037 | A1 | 9/2006 | Tsai | |
| 2006/0293119 | A1 | 12/2006 | Hou | |
| 2009/0111603 | A1 | 4/2009 | Romero | |
| 2013/0344988 | A1* | 12/2013 | Hettinger | A63B 60/00 473/349 |
| 2014/0295993 | A1 | 10/2014 | Tsurumaki | |

* cited by examiner

MULTI-STAGE FORGING PROCESS

CROSS-REFERENCE TO RELATED APPLICATIONS

This claims the benefit of U.S. Provisional Patent Appl. No. 62/732,438, filed on Sep. 17, 2018, the contents of all of which are incorporated fully herein by reference.

TECHNICAL FIELD

This disclosure relates generally to golf clubs and relates more particularly to a method of manufacturing a forged iron with a cavity.

BACKGROUND

In general, iron type golf club heads can be made by a variety of methods such as casting, co-casting, metal injection molding, machine milling, and forging. Many iron type golf club heads contain cavities or filling features to adjust the performance features of the golf club head when it strikes a golf ball. Often times, irons that contain cavities are casted or co-casted, in order to achieve these advanced geometries. Milling techniques are used to create club heads with cavities from a single block of material, however this is an expensive and timely process. Further, forging techniques are often used to create an iron golf club head that is formed of an integral block of material. Forging is cheaper and quicker than milling, however the geometries that can be achieved are limited. With current industry techniques, it is difficult to quickly and cheaply create a forged iron type club head with any kind of cavity. There is a need in the art for a forged golf club head with a cavity.

BRIEF DESCRIPTION OF THE DRAWINGS

To facilitate further description of the embodiments, the following drawings are provided in which.

Figure 1:
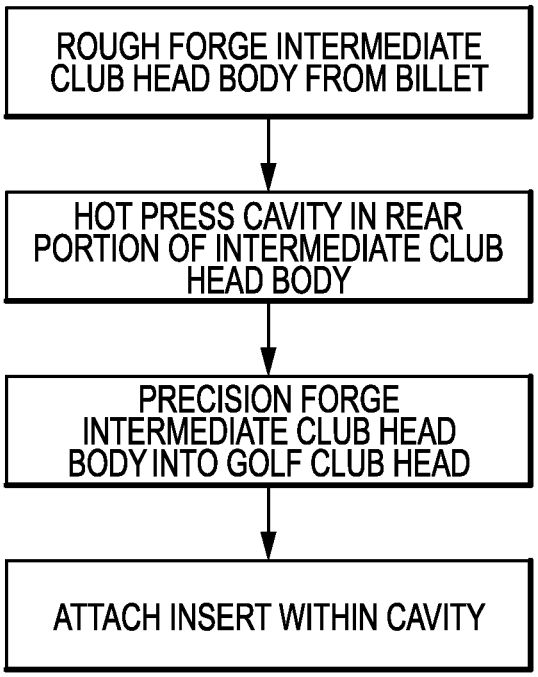
FIG. 1 illustrates a flow diagram representation of one embodiment in which the exemplary golf club heads can be manufactured.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein is method of manufacturing an iron type golf club with a cavity, via a multi-stage forging process.

The method comprises: rough forging solid block billet of a suitable metal to create an intermediate club head body, hot pressing the intermediate club head to create a cavity in the body, precision forging the intermediate club head to create a golf club body, and then attaching an insert within the cavity. The intermediate club head, formed through rough forging, comprises a bent strike face, allowing a cavity to be formed in the rear body via hot pressing. The bent strike face of the intermediate club head is then precision forged. This bent strike face technique allows a manufacturer to create a forged golf club head body with a deep undercut cavity, from a single solid billet, as the bent strike face provides room to hot press a cavity.

It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. Furthermore, the term "rough forging" describes a forging technique wherein a block shaped billet is quickly formed into a general desired shape, with minimal tooling or machining.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

In general, methods, apparatuses, and articles of manufacture associated with golf clubs, and in particular golf club heads are described herein. The methods, apparatuses, and articles of manufacture described herein are not limited in this regard.

FIGS. 1-4 illustrate a method of manufacturing (multi-stage forging process) a forged iron-type golf club head with a cavity. The method of manufacturing the iron-type golf club head with cavity comprises a rough forging stage, a hot-pressing stage, and a precision forging stage. The method of manufacturing a forged iron-type golf club head with cavity, illustrated in FIG. 5, can form a single iron-type golf club head with cavity, or a set of iron-type golf club heads with cavities.

A single iron-type golf club head with cavity, formed by the multi-stage forging process, can comprise a loft angle ranging between 60 degress and 16 degress. In many embodiments, the loft angle of the club head is less than approximately 60 degress, the loft angle of the club head is less than approximately 59, degress, the loft angle of the club head is less than approximately 58 degress, the loft angle of the club head is less than approximately 57 degress the loft angle of the club head is less than approximately 56 degrees, the loft angle of the club head is less than approximately 55 degress, the loft angle of the club head is less than approximately 54 degress, the loft angle of the club head is less than approximately 53 degress, the loft angle of the club head is less than approximately 52 degress, the loft angle of the club head is less than approximately 51 degrees, the loft angle of the club head is less than approximately 50 degress, less than approximately 49 degress, less than approximately 48 degress, less than approximately 47 degress, less than approximately 46 degress, less than approximately 45 degress, less than approximately 44 degress, less than approximately 43 degress, less than approximately 42 degrees, less than approximately 41 degress, or less than approximately 40 degress. Further, in many embodiments, the loft angle of the club head is greater than approximately 16 degress, greater than approximately 17 degress, greater than approximately 18 degress, greater than approximately 19 degress, greater than approximately 20 degress, greater than approximately 21 degress, greater than approximately 22 degress, greater than approximately 23 degress, greater than approximately 24 degress, or greater than approximately 25 degress. Further still, the multi-stage forging process can form multiple iron-type golf club heads with cavities, wherein the multiple iron-type golf club heads with cavities will comprise different lofts (aforementioned) to form a set of golf clubs (i.e., 3 iron, 4 iron, 5 iron, 6 iron, 7 iron, 8 iron, 9 iron, PW). In some embodiments, the multi-stage forging process can form multiple iron-type golf club heads with identically sized cavities, and different lofts to form a set of golf clubs.

A. Rough Forging

Referring to FIG. 1, the multi-stage forging method, comprises four stages: (1) a rough forging stage, in which intermediate club head body 10 is formed from a solid block billet (not shown); (2) a hot-pressing stage, in which a cavity 58 is formed in the intermediate club head body; (3) a precision forging stage wherein the intermediate club head body 10 is formed into a final golf club head 80; (4) and an insert 110 or filling is placed within the cavity 58 of the golf club head body 80. This multi-stage forging method allows a manufacturer to create a forged golf club head 80 with a deep undercut cavity 58, from a single solid billet. In some embodiments, the multi-stage forging method can comprise a fifth stage (not shown), wherein a shaft and grip are attached to the golf club head body 80, to form a golf club.

To begin the multi-stage forging method, a billeted material is provided. The billet is forged into an iron type golf club head and can be any one or more combination of the following: 8620 alloy steel, S25C steel, carbon steel, maraging steel, stainless steel, stainless steel alloy, tungsten, aluminum, aluminum alloy, or any metal suitable for forging. The billet can be a solid block with no cavities or other materials attached to the billet. Further, the billet does not monolithically encase any other material. The one or more materials can be present on the surface of the billet, multiple surfaces of the billet, or a corner of the billet.

In another embodiment, the solid billet can include two or more metals. The multi-metal billet is forged into an iron type golf club head and can be any one or more combination of the following: 8620 alloy steel, S25C steel, carbon steel, maraging steel, stainless steel, stainless steel alloy, tungsten, aluminum, aluminum alloy, or any metal suitable for forging. The multi-metal billet does not monolithically encase any other material. The multi-metal billet can comprise a base metal, with at least one different metal on the surface of the billet, at least one different metal on multiple surface of the billet, or at least one different metal on a corner of the billet.

Figure 2:
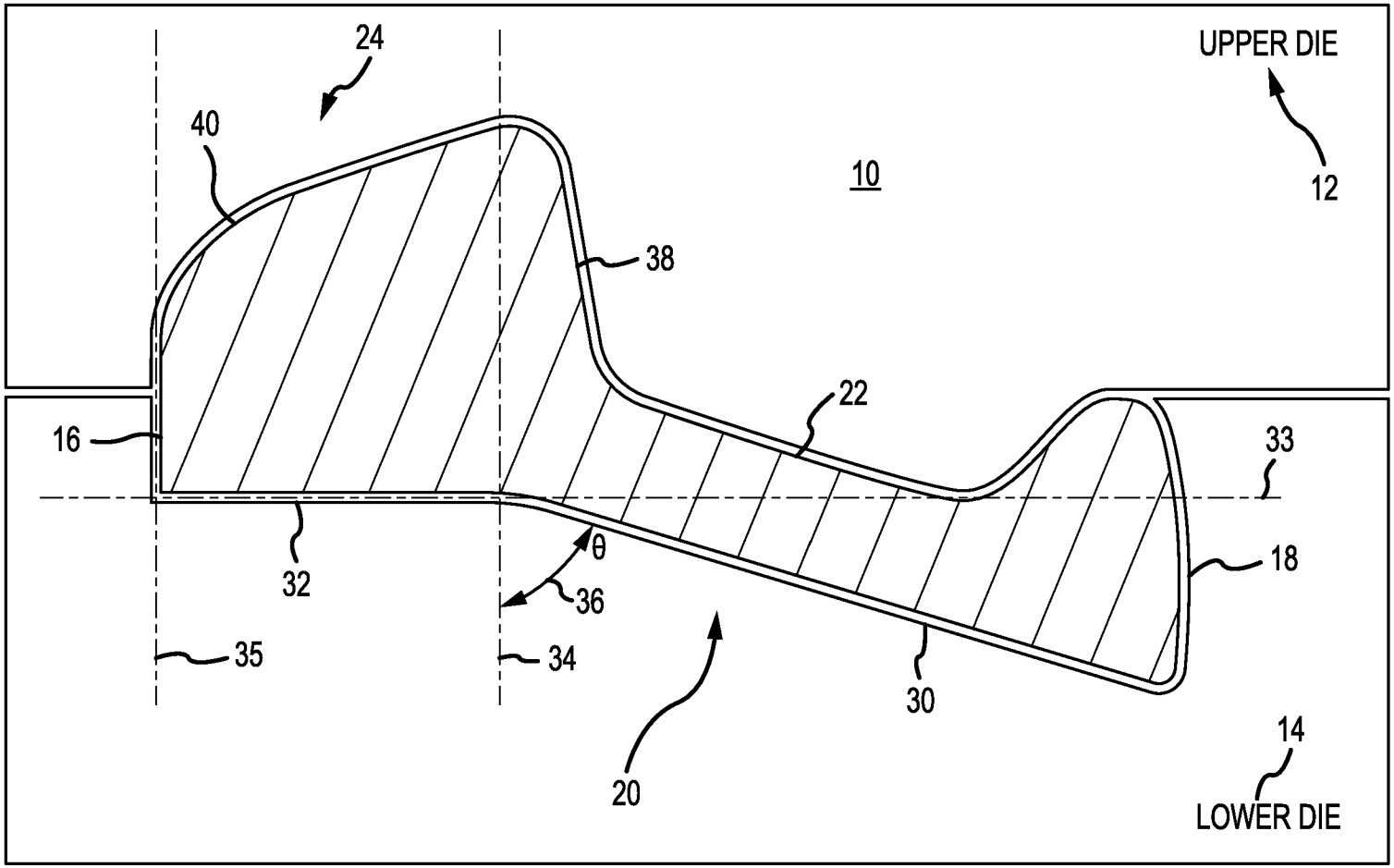
FIG. 2 illustrates a cross-sectional view of a first stage of a forging method.

The next step of the multi-stage forging process is to forge the billet to into an intermediate club head 10. Referring to FIG. 2, the intermediate club head body 10 is formed from a solid block billet that is rough forged by a first upper die 12 and a first lower die 14. The first upper die 12 and first lower die 14 are shaped in a desired club head geometry. The solid block billet is heated to a desired temperature between 700° C. and 1100° C., making the billet very malleable, thus allowing forging to occur. In some embodiments, the desired billet temperature for rough forging is between 700-725° C., 725-750° C., 750-775° C., 775-800° C., 800-825° C., 825-850° C., 850-875° C., 875-900° C., 900-925° C., 925-950° C., 950-975° C., 975-1000° C., 1000-1025° C., 1025-1050° C., 1050-1075° C., 1075-1100° C. In one embodiment, the desired billet temperature for rough forging is between 800-825° C.

Once the solid block billet is heated to a desired temperature, the first upper die 12 and first lower die 14 apply a desired pressure to the billet, shaping the malleable billet to the shape of the desired geometry. The desired pressure that is applied to the billet by the first upper die 12 and the first lower die 14 is between 500 tons and 800 tons (1 ton is equivalent to 2000 pounds force). In some embodiments, the desired pressure of the upper die 12 and lower die 14 is between 500-525 tons, 525-550 tons, 550-575 tons, 575-600 tons, 600-625 tons, 625-650 tons, 650-675 tons, 675-700 tons, 700-725 tons, 725-750 tons, 750-775 tons, and 775-800 tons. In some embodiments, the desired pressure of the upper die 12 and lower die 14 is between 600 tons and 625 tons. The extreme pressure of the upper die 12 and lower die 14, quickly forms the malleable solid block billet to the desired geometry, thus maintaining the material and tensile properties of the metallic billet.

Referring to FIG. 2, is a cross-sectional view of the upper die 12 and lower die 14 forming the intermediate club head body 10, from the solid block billet. The intermediate club head body 10 that is formed from the rough forging comprises: a sole 16, a top rail 18, a strike face 20, a back wall 22 of the strike face 20, and a rear portion 24. The strike face 20 has a heel end (not shown), a toe end (not shown), an upper region 30, a lower region 32, and a strike plane 33. The strike plane 33 is parallel to the lower region 32 of the strike face 20 and is the desired plane that the strike face 20 will be bent to in a later step. The upper region 30 is opposite the back wall 22 of the strike face 20, while the lower region 32 is opposite the rear portion 24.

The rear portion 24 extends away from the strike face 20 and is adjacent the sole 16. Further, the rear portion 24 comprises an upper edge 38. The upper edge 38 is approximately perpendicular to the strike plane 33 and the lower region 32. The upper edge 38 provides a surface, or ledge, to form a cavity within, in a later step. The rear portion 24 further comprises a nonlinear outer periphery 40. The upper edge 38 spans the back wall of the strike face 22 from the heel end to the toe end. The nonlinear outer periphery 40 connects the sole 16 to the upper edge 38 of the rear portion 24.

The back wall 22 of the strike face 20, is adjacent the top rail 18 and the upper edge 38, while parallel to the upper region 30 of the strike face 20. The back wall 22 of the strike face 20 spans approximately from the heel end to the toe end.

The upper region 30 and lower region 32 of the strike face of the intermediate club head body 10, are divided by an intersection plane 34, wherein the intersection plane 34 is perpendicular to the lower region 32 of the strike face 20 and the strike plane 33. The intersection plane 34 is also approximately parallel to the upper edge 38 of the rear portion 24. The intersection plane 34 enables the forging of a cavity in the rear portion 24 of the intermediate club head body 10. The intersection plane 34 is the plane that which the strike face 20 is bent about and is a bending point for creating the cavity 58 from the forged billet.

The intersection plane 34 runs approximately parallel to a ground plane 35, wherein the ground plane 35 intersects the sole 16. In most embodiments, the ground plane 35 is tangential to and parallel to the sole 16. In some embodiments, the ground plane 35 intersects the sole 16 at an angle, not parallel to sole 16.

Further still, the intersection plane 34 intersects the strike face of the intermediate club head body 10, approximately bisecting the intermediate club head body 10, dividing the upper region 30 and the lower region 32. The intermediate club head body 10, further comprises a height measured from the sole 16 to the top rail 18. In most embodiments, the intersection plane 34 intersect the intermediate club head body 10 between 20-70% of the height of the club head body 10. In some embodiments, the intersection plane 34 intersects the club head body 10 at approximately 20%, 25%, 30%, 35%, 40%, 45%, 50%, 55%, 60%, 65%, or 70% of the height of the club head body 10. In some embodiments, the intersection plane 34 intersects the club head body 10 between approximately 20%-30%, 30%-40%, 40%-50%, 50%-60%, or 60%-70% of the height of the club head body 10 or any other suitable percentage height value in between those percentage height values, and can range from any one of those percentage height values to any other one of those percentage height values.

A clearance angle 36 is formed between the intersection plane 34 and the upper region 30 of the strike face 20. The clearance angle 36 enables enough space for a second upper die 54 and a second lower die 56 to create a cavity 58 in the intermediate club head 10 in a later step. The clearance angle 36 can range between 1° and 89°. In some embodiments, the clearance angle 36 can range between 5° and 35°. In other embodiments, the clearance angle 36 can range between 5°-11°, 9°-18°, and 13°-35°. In other embodiments, the clearance angle 36 can be 5°, 6°, 7°, 8°, 9°, 10°, 11°, 12°, 13°, 14°, 15°, 16°, 17°, 18°, 19°, 20°, 21°, 22°, 23°, 24°, 25°, 26°, 27°, 28°, 29°, 30°, 31°, 32°, 33°, 34°, and 35°.

B. Cavity Formation

Figure 3:
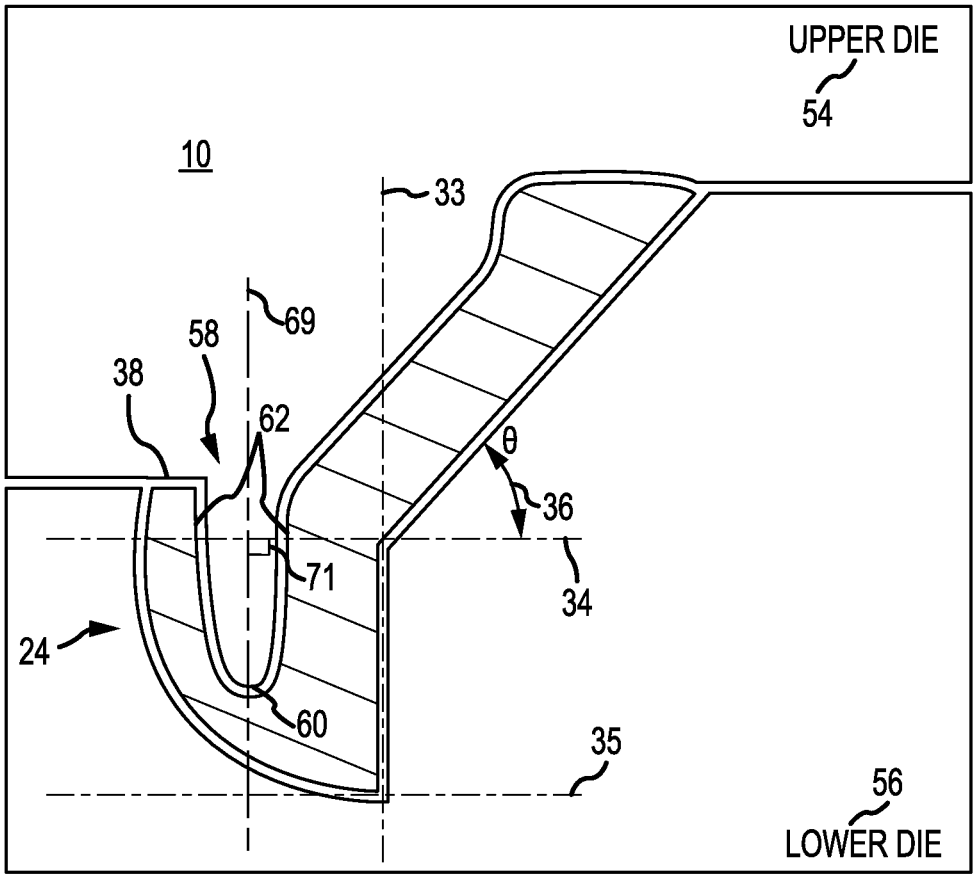
FIG. 3 illustrates a cross-sectional view of a second stage of a forging method.

Referring to FIG. 3, the next step of the multi-stage forging method is the cavity 58 formation in the intermediate club head body 10. Formation of the cavity 58 from the intermediate club head body 10 is accomplished by one or more of the following processes: hot pressing, machining, milling, drilling, or machine punching. The embodiment in FIG. 3, illustrates the hot-pressing technique. The hot-pressing technique utilizes the second upper die 54 and the second lower die 56 (wherein the second upper die 54 and second lower die 56 are different in shape from the first upper die 12 and first lower die 14 of the rough forging stage) to precisely dimension a cavity 58 generally perpendicular to the upper edge 38 in the rear portion 24 of the intermediate club head body 10. The second upper die 54 comprises a sharp geometry to penetrate through the upper edge 38 of the rear portion 24, while the second lower die 56 holds the intermediate club head 10 at the desired clearance angle 36, thus forming the cavity 58.

The necessary temperature required to hot press the cavity 58 in the intermediate club head body 10 can range between 700° C. and 1150° C. In order to avoid strain hardening of the metal during deformation, this extreme heat is necessary for the hot-pressing process. If strain hardening occurs, the intermediate club head body 10 will become less malleable, making the cavity 58 harder to form. In some embodiments, the temperature required to hot press the cavity 58 in the intermediate club head body 10 can range between 700-725° C., 725-750° C., 750-775° C., 775-800° C., 800-825° C., 825-850° C., 850-875° C., 875-900° C., 900-925° C., 925-950° C., 950-975° C., 975-1000° C., 1000-1025° C., 1025-1050° C., 1050-1075° C., 1075-1100° C., 1100-1125° C., 1125-1150° C. In one embodiment, the temperature required to hot press the cavity 58 in the intermediate club head body 10 can range between 775° C. and 800° C.

Once the intermediate club head body 10 is heated to a desired temperature, the second lower die 56 apply a desired pressure to the intermediate club head body 10 maintaining shape (strike face 20, bent about an intersection plane 34, at a desired clearance angle 36). The cavity 58 is then formed as the second upper die 54 applies a desired pressure and the sharp geometry penetrates through the upper edge 38 and within the rear portion 24. The desired pressure that is applied to the intermediate club head body 10 by the second upper die 54 and the second lower die 56 is between 500 tons and 800 tons (1 ton is equivalent to 2000 pounds force). In some embodiments, the desired pressure of the second upper die 54 and second lower die 56 is between 500-525 tons, 525-550 tons, 550-575 tons, 575-600 tons, 600-625 tons, 625-650 tons, 650-675 tons, 675-700 tons, 700-725 tons, 725-750 tons, 750-775 tons, and 775-800 tons. In some embodiments, the desired pressure of the upper die 54 and lower die 56 is between 675 tons and 700 tons. The extreme pressure of the second upper die 54 and second lower die 56, quickly forms the cavity 58 in the intermediate club head body 10, thus maintaining the material and tensile properties of the metallic intermediate club head body 10.

The cavity 58 formed by the methods described above, including hot-pressing, comprises a lower surface 60 and two interior surface walls 62. The cavity 58 further comprises a surface area and a volume, that can provide a surface and region to affix an insert to, in a later step.

Further, the cavity 58 comprises a cavity axis 69. The cavity axis 69 passes through a nadir of the cavity 58 lower surface 60. The cavity axis 69 exactly bisects the cavity 58 and is equidistant from the cavity 58 interior surface walls 68. The cavity 58 can be hot-pressed at an angle 71, wherein the press angle 71 is measured from the cavity axis 69 to the intersection plane 34. The press angle can range between 60° and 90°. In some embodiments, the press angle 71 can range between 60°-65°, 65°-70°, 70°-75°, 75°-80°, and 85°-90° or any other suitable press angle 71 value in between those press angles 71 and can range from any one of those press angles 71 to any other one of those press angles 71. In other embodiments, the press angle 71 can be 60°, 61°, 62°, 63°, 64°, 65°, 66°, 67°, 68°, 69°, 70°, 71°, 72°, 73°, 74°, 75°, 76°, 77°, 78°, 79°, 80°, 81°, 82°, 83°, 84°, 85°, 86°, 87°, 88°, 89°, or 90°. The press angle 71, enables an insert to be affixed within the cavity 58 (in a later step) at a desired angle. Furthermore, the press angle 71 enables a set of iron-type golf club heads with cavities to be formed, via the multi-stage forging method, with identical press angles 71, and/or dissimilar press angles 71.

Further still, the cavity 58 can have a substantially triangular, rectangular, square, semi-circular, parabolic, or trapezoidal cross section. In some embodiments, the cavity 58 can comprise a different cross-section at a toe end of the cavity 58 and the heel end of the cavity 58.

In some embodiments, the cavity 58 can have a volume of approximately 0.8 cc, 1.0 cc, 1.25 cc, 1.5 cc, 1.75 cc, 2.0 cc, 2.25 cc, 2.5 cc, 2.75 cc, 3.0 cc, 3.25 cc, 3.5 cc, 3.75 cc, 4.0 cc, 4.25 cc, 4.5 cc, 4.75 cc, 5.0 cc, 5.25 cc, 5.5 cc, 5.75 cc, 6.0 cc, 6.25 cc, 6.5 cc, 6.75 cc, 7.0 cc, 7.25 cc, 7.5 cc, 7.75 cc, 8.0 cc, 8.25 cc, 8.5 cc, 8.75 cc, 9.0 cc, 9.25 cc, 9.5 cc, 9.75 cc, 10.0 cc, 10.25 cc, 10.5 cc, 10.75 cc, 11.0 cc, 11.25 cc, 11.5 cc, 11.75 cc, 12.0 cc, 12.25 cc, 12.5 cc, 12.75 cc, 13.0 cc, 13.25 cc, 13.5 cc, 13.75 cc, 14.0 cc, 14.25 cc, 14.5 cc, 14.75 cc, 15.0 cc, 15.25 cc, 15.5 cc, 15.75 cc, 16.0 cc, or any other suitable volume value in between those volume values, and can range from any one of those volume values to any other one of those volume values. In one embodiment, the volume of the cavity 58 is 4.25 cc. The volume of the cavity 58 can be substantially similar to the volume of an insert that is affixed within the cavity 58.

In some embodiments, the cavity 58 can have a surface area ranging between approximately 3.00-4.00 $cm^2$, 4.00-5.00 $cm^2$, 5.00-6.00 $cm^2$, 6.00-7.00 $cm^2$, 7.00-8.00 $cm^2$, 8.00-9.00 $cm^2$, 10.00-11.00 $cm^2$, 11.00-12.00 $cm^2$, 12.00-13.00 $cm^2$, 13.00-14.00 $cm^2$, 14.00-15.00 $cm^2$, 15.00-16.00 $cm^2$, 16.00-17.00 $cm^2$, 17.00-18.00 $cm^2$, 18.00-19.00 $cm^2$, 19.00-20.00 $cm^2$, 20.00-21.00 $cm^2$, 21.00-22.00 $cm^2$, 22.00-23.00 $cm^2$, 23.00-24.00 $cm^2$, 24.00-25.00 $cm^2$, 25.00-26.00 $cm^2$, 26.00-27.00 $cm^2$, 27.00-28.00 $cm^2$, 28.00-29.00 $cm^2$, or 29.00-30.00 $cm^2$. In other embodiments, the surface area of the cavity 58 can be any other suitable surface area value in between those surface area values and can range from any one of those surface area values to any other one of those surface area values. The surface area of the cavity 58 can be substantially similar to the surface area of an insert that is affixed within the cavity 58.

In some embodiments, the cavity 58 can have a depth of approximately 0.05 inches, 0.10 inches, 0.15 inches, 0.20 inches, 0.25 inches, 0.30 inches, 0.35 inches, 0.40 inches, 0.45 inches, 0.50 inches, 0.55 inches, 0.60 inches, 0.65 inches, 0.70 inches, 0.75 inches, 0.80 inches, 0.85 inches, 0.90 inches, 0.95 inches, 1.0 inches or any other suitable depth value in between those depth values, and can range from any one of those depth values to any other on of those depth values. The depth of the cavity 58 can be substantially similar to a height of an insert that is affixed within the cavity 58.

Following the cavity 58 formation in the intermediate club head body 10, a final precision forging stage is performed to straighten the clearance angle 36 into a final golf club head.

C. Precision Forging

After the hot-pressing of the cavity 58 into the intermediate club head body 10, the club head body 10 is precision forged, wherein the strike face 20 is bent to a final angle 96, wherein the final angle 96 is formed between the intersection plane 34 and the strike face 20. The final angle 96 is approximately between 88°-92° or 88°, 89°, 90°, 91°, or 92°, thereby aligning the upper region 30 with the lower region 32 of the club heady body 10. The intermediate club head body 10 is therefore forged further into a final golf club head 80.

Figure 4:
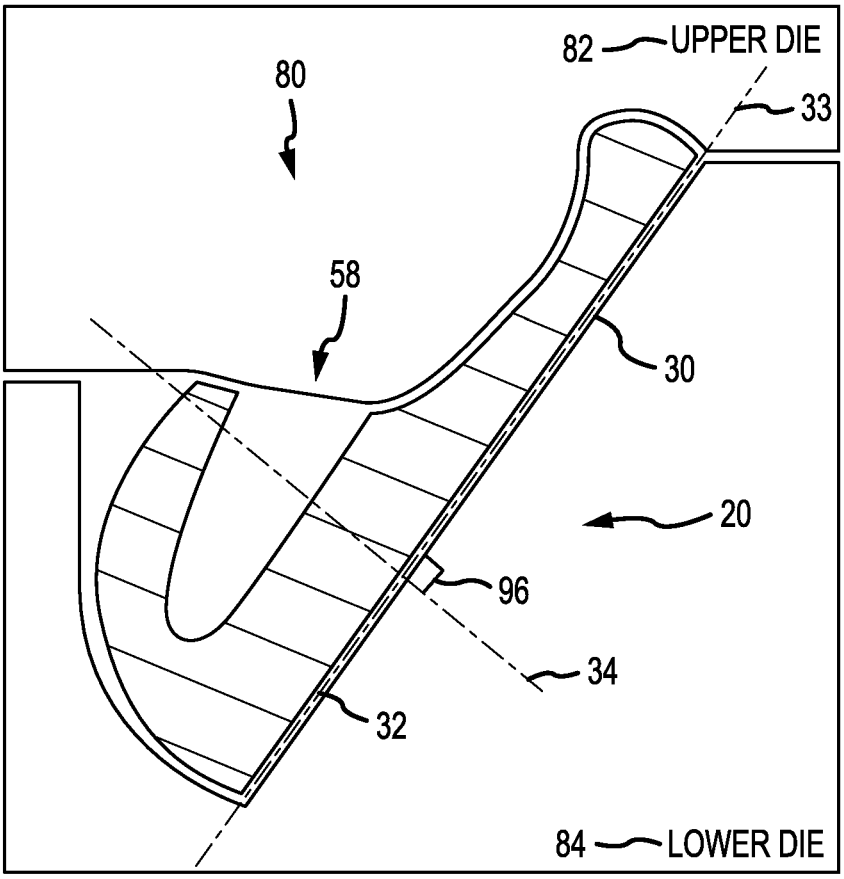
FIG. 4 illustrates a cross-sectional view of a third stage of a forging method.

Referring to FIG. 4, this precision forging stage comprises a third upper die 82 and a third lower die 84, wherein the third upper die 82 and third lower die 84 are shaped in a desired geometry (wherein the second upper die 54, the second lower die 56, the first upper die 12, and the first lower die 14 are different in shape from the third upper die 82 and third lower die 84). The third upper die 82 and third lower die 84 apply a desired pressure to the intermediate club head body 10, bending the upper portion 30 of the strike face 20 to align with the lower portion 32 of the strike face 20 within the strike plane 33, thus bending the clearance angle 36 to a final angle 96 of approximately 90° to the intersection plane 36. In doing so, the intermediate club head body 10 is forged into a final golf club head 80, as the strike face 20 is now continuously straight and can function for its intended purpose of striking a golf ball.

The intermediate club head body 10, formed from the previous steps, must be heated to a desired temperature to bend the strike face 20 into the strike plane 33 in order to carry out this stage of the method. The intermediate club head body 10 is heated to a desired temperature between 700° C. and 1100° C. In some embodiments, the desired temperature of the intermediate club head body 10 for precision forging is between 700-725° C., 725-750° C., 750-775° C., 775-800° C., 800-825° C., 825-850° C., 850-875° C., 875-900° C., 900-925° C., 925-950° C., 950-975° C., 975-1000° C., 1000-1025° C., 1025-1050° C., 1050-1075° C., 1075-1100° C. In one embodiment, the desired temperature of the intermediate club head body 10 for rough forging is between 800-825° C.

Once the intermediate club head body 10 is heated to a desired temperature, the lower die 84 maintains the shape of the cavity and lower portion 32, while the third upper die 82 presses against the back wall 22. The third upper die 82 forces the upper portion 30 of the intermediate club head body 10 flush against the third lower die 84, thus aligning the upper portion 30 with the lower portion, and therefore bending the clearance angle 36 to approximately 90° to the intersection plane 36. The desired pressure that is applied to the intermediate club head body 10 by the third upper die 82 and the third lower die 84 is between 500 tons and 800 tons (1 ton is equivalent to 2000 pounds force). In some embodiments, the desired pressure of the third upper die 82 and the third lower die 84 is between 500-525 tons, 525-550 tons, 550-575 tons, 575-600 tons, 600-625 tons, 625-650 tons, 650-675 tons, 675-700 tons, 700-725 tons, 725-750 tons, 750-775 tons, and 775-800 tons. In some embodiments, the desired pressure of the third upper die 82 and the third lower die 84 is between 675 tons and 700 tons. The extreme pressure of the upper die 82 and the third lower die 84, maintains the form of the lower portion 32 and the cavity 58, while pressing the upper region 30, in line with the lower region 32, and thus into a functioning strike face 20. The strike face is then removed from the third upper die 82 and third lower die 84, and set to cool in a room temperature environment, until it is safe to the touch.

D. Insert Placement

Figure 5:
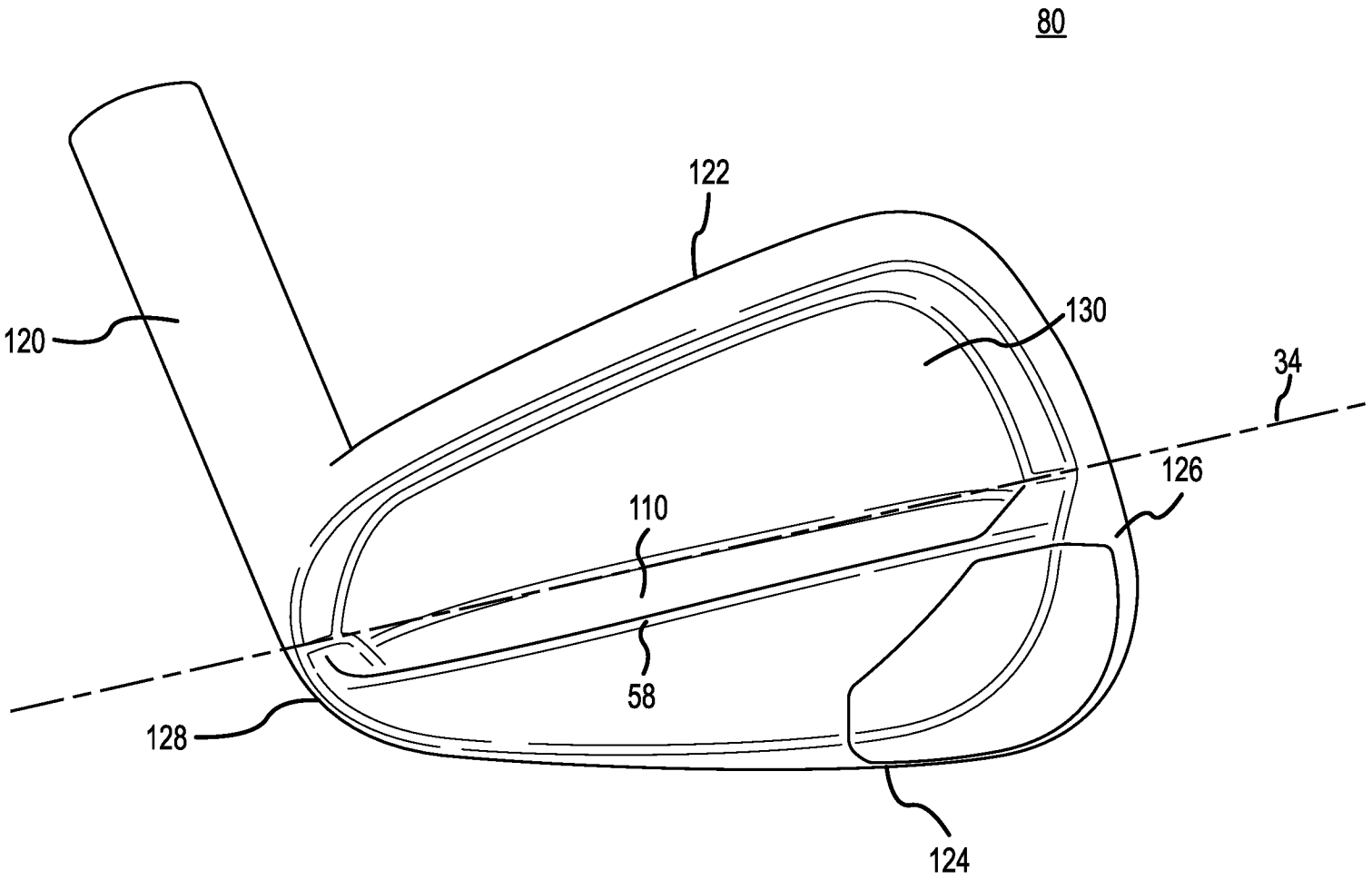
FIG. 5 illustrates a final golf club head with cavity.

Referencing FIG. 5, following the three stages of forging the final golf club head 80, an insert 110 can be affixed to the interior surface wall 62 and lower surface 60 of the cavity 58. In some embodiments, nothing is placed with the cavity 58. The insert 110 can be secured into the cavity 58 via adhesion, press-fitting, mechanical fastening, or any other suitable methods of securing the insert 110. The insert 110 can be made of one or more elastomers. For example, the insert 110 can be made of nonferrous thermoplastic urethane, thermoplastic elastomeric polymer(s), hybrid plastics with a mix of ferrous particles or other alloy ferrous particles mixed into polyurethane or other elastomeric polymers. In other embodiments, the insert 110 can be a metal such as aluminum, steel, tungsten, forms of beads in polymer, powder metal in a suspension cured in a polymer, or other suitable metals, such as when the insert 110 is sintered or machined.

Further, the insert 110 can occupy the entire cavity 58 or a percentage of the cavity 58. The percentage of the cavity 58 that is occupied can range between 5% and 100%. In some embodiments, the percentage of the cavity 58 that is occupied can range between 5%-15%, 15%-25%, 25%-35%, 35%-45%, 45%-55%, 55%-65%, 65%-75%-85%, 85%-95%, 95%-100%. In one embodiment, the percentage of the cavity 58 that is occupied ranges between 95%-100%.

In many embodiments, the insert 110 can have a weight that advantageously can be configured to reinforce the strike face 20, to beneficially minimize undesirable impact vibration, and/or to establish or adjust the golf club swing weight during assembly. For example, the insert 110 can have a mass of approximately 1.0 g to approximately 100 g. For example, tuning element 150 can have a mass of approximately 1.0 g, 2.0 g, 3.0 g, 4.0 g, 5.0 g, 6.0 g, 7.0 g, 8.0 g, 9.0 g, 10.0 g, 11.0 g, 12.0 g, 13.0 g, 14.0 g, 15.0 g, 16.0 g, 17.0 g, 18.0 g, 19.0 g, 20.0 g, 21.0 g, 22.0 g, 23.0 g, 24.0 g, 25.0 g, 26.0 g, 27.0 g, 28.0 g, 29.0 g, 30.0 g, 35.0 g, 40.0 g, 45.0 g, 50.0 g, 55.0 g, 60.0 g, 65.0 g, 70.0 g, 75.0 g, 80.0 g, 85.0 g, 90.0 g, 95.0 g, 100.0 g, or any other suitable mass in between those mass values, and can range from any one of those mass values to any other one of those distance values. For example, in some embodiments, the insert 110 can have a mass of approximately 1.0 g to approximately 30.0 g.

In several embodiments, the insert 110 can have a density of approximately 1.0 g/cc to approximately 20.0 g/cc. For example, the insert 110 can have a density of approximately 1.0 g/cc, 1.5 g/cc, 2.0 g/cc, 2.5 g/cc, 3.0 g/cc, 3.5 g/cc, 4.0 g/cc, 4.5 g/cc, 5.0 g/cc, 5.5 g/cc, 6.0 g/cc, 6.5 g/cc, 7.0 g/cc, 7.5 g/cc, 8.0 g/cc, 8.5 g/cc, 9.0 g/cc, 9.5 g/cc, 10.0 g/cc, 10.5 g/cc, 11.0 g/cc, 11.5 g/cc, 12.0 g/cc, 12.5 g/cc, 13.0 g/cc, 13.5 g/cc, 14.0 g/cc, 14.5 g/cc, 15.0 g/cc, 15.5 g/cc, 16.0 g/cc, 16.5 g/cc, 17.0 g/cc, 17.5 g/cc, 18.0 g/cc, 18.5 g/cc, 19.0 g/cc, 19.5 g/cc, 20.0 g/cc, or any other suitable density value in between those density values, and can range from any one of those density values to any other one of those density values.

In reference to FIG. 5, the final golf club 80, formed by the aforementioned manufacturing process, is a forged iron type golf club head with a cavity 58. The final golf club 80 comprises: a hosel 120, a top rail 122, a sole 124, a toe region 126, a heel region 128, a rear 130, a strike face 20 (not shown), a cavity 58, and an insert 110.

E. Method of Manufacturing a Set of Golf Clubs and a Forged Set of Clubs with Similar Sized Cavities Referring to FIG. 1, the multi-stage forging method, comprises four stages: (1) a rough forging stage, in which intermediate club head body 10 is formed from a solid block billet (not shown); (2) a hot-pressing stage, in which a cavity 58 is formed in the intermediate club head body; (3) a precision forging stage wherein the intermediate club head body 10 is formed into a final golf club head 80; (4) and an insert 110 or filling is placed within the cavity 58 of the golf club head body 80. This multi-stage forging method allows a manufacturer to create a forged golf club head 80 with a deep undercut cavity 58, from a single solid billet. However, in this embodiment, the multi-stage forging method comprises a fifth stage (not shown), wherein a shaft and grip are attached to the golf club head body 80, to form a golf club. The multi-stage forging process is then repeated to form multiple iron-type golf club heads with cavities, wherein the multiple iron-type golf clubs with cavities will comprise different lofts (aforementioned) to form a set of golf clubs (i.e., 3 iron, 4 iron, 5 iron, 6 iron, 7 iron, 8 iron, 9 iron, PW).

In some embodiments, the multi-stage forging process can form multiple iron-type golf club heads with identically sized cavities, and different lofts to form a set of golf clubs. With identically sized cavities, the inserts that are affixed to each golf club head, all have an exact same volume, but can have varying densities and therefore varying masses. This variability allows the inserts for each golf club head of the golf club set to have different swing weights and/or different CG locations. Furthermore, this make the manufacturing of the inserts more efficient, since only the material (therefore changing the density) of the insert needs to be changed, in order to change the weighting of the insert, for each club head. Inserts are produced at different weights in order to account for manufacturing tolerances (i.e., if a golf club head is supposed to weight 425 grams, but only weighs 415 grams, then a 10 gram weight can be added to the golf club head cavity).

The aforementioned method of manufacturing produces can produce of set of forged iron-type golf clubs with similar sized cavities. In reference to FIG. 5, the final golf club head 80 formed by the method of manufacturing comprises a hosel 120, a top rail 122, a sole 124, a toe region 126, a heel region 128, a rear 130, a strike face 20 (not shown), a cavity 58, an insert 110, a shaft (not shown), and a grip (not shown). The set of forged iron-type golf clubs can comprise 2 golf clubs, 3 golf clubs, 4 golf clubs, 5 golf clubs, 6 golf clubs, 7 golf clubs, 8 golf clubs, 9 golf clubs, or 10 golf clubs.

Each golf club of the forged iron-type golf club set can comprise cavity 58 having a volume of approximately 0.8 cc, 1.0 cc, 1.25 cc, 1.5 cc, 1.75 cc, 2.0 cc, 2.25 cc, 2.5 cc, 2.75 cc, 3.0 cc, 3.25 cc, 3.5 cc, 3.75 cc, 4.0 cc, 4.25 cc, 4.5 cc, 4.75 cc, 5.0 cc, 5.25 cc, 5.5 cc, 5.75 cc, 6.0 cc, 6.25 cc, 6.5 cc, 6.75 cc, 7.0 cc, 7.25 cc, 7.5 cc, 7.75 cc, 8.0 cc, 8.25 cc, 8.5 cc, 8.75 cc, 9.0 cc, 9.25 cc, 9.5 cc, 9.75 cc, 10.0 cc, 10.25 cc, 10.5 cc, 10.75 cc, 11.0 cc, 11.25 cc, 11.5 cc, 11.75 cc, 12.0 cc, 12.25 cc, 12.5 cc, 12.75 cc, 13.0 cc, 13.25 cc, 13.5 cc, 13.75 cc, 14.0 cc, 14.25 cc, 14.5 cc, 14.75 cc, 15.0 cc, 15.25 cc, 15.5 cc, 15.75 cc, 16.0 cc, or any other suitable volume value in between those volume values, and can range from any one of those volume values to any other one of those volume values. In one embodiment, the volume of the cavity 58 is 4.25 cc. The volume of the cavity 58 can be substantially similar to the volume of an insert that is affixed within the cavity 58. The volume can also be approximately identical for each golf club of the forged iron-type golf club set.

F. Benefits

The enclosed manufacturing process is an improvement over the current industry standard. The multi-stage forging process utilizes a dual stage forging process, in which an intermediate club head 10 is formed with a strike face 20 that is bent at a clearance angle 36, enabling a cavity 58 to be hot pressed opposite of the strike face 20. The strike face 20 is then bent back into a functional strike face 20, and a final golf club head 80 is created. This bent strike face 20 technique allows a manufacturer to create a forged golf club head body 80 with a deep undercut cavity 58, from a single solid billet.

By creating an entirely forged golf club head 80, with a deep undercut cavity 58, a tighter grain structure of the golf club head is achieved. With a tighter grain structure, the durability of the golf club head 80 is improved. Forging the golf club head 80 with a deep undercut cavity 58 from the billet process, allows a more durable cavity style iron than current cast cavity irons, because of a tighter and more consistent grain structure.

Further, this multi-stage forging method is more repeatable than current casting methods. Current casting methods require manual machining processes to remove excess material and clean the shape of the club head, whereas the forging method requires little to no machining. Thus, the forging process is more repeatable since there is less uncertainty involved from hand machining techniques. Furthermore, with less machining processes involved in the golf club head production, the enclosed invention lowers the overall cost of producing a premium golf club head with an undercut cavity.

The golf club head created from this multi-stage forging method, is comparable in feel and performance to a casted golf club head of similar geometry. Since the forged iron comprises a stronger composition, the strike face is able to be made thinner, thereby increasing the flexibility of the strike face. The forged iron thus increases ball speed and workability (shot bend) over a casted golf club head of similar geometry, while maintaining or improving spin rates, sound characteristics, and feel characteristics.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron golf club, the apparatus, methods, and articles of manufacture described herein may be applicable to other types of golf club such as a wedge-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

Clause 1: A method of manufacturing a golf club head, the method comprising: providing a billet of at least one material; forming the billet into an intermediate club head body by means of forging, wherein the intermediate body comprises: a sole, a top rail, a strike face, a back wall of the strike face, and a rear portion, wherein the rear portion of the body has an upper edge and a nonlinear outer periphery, wherein the strike face comprises an upper region, and a lower region, wherein the upper region and lower region of the strike face are divided by an intersection plane, wherein the intersection plane is perpendicular to the lower region of the strike face, wherein the strike face is formed at a clearance angle, wherein the clearance angle is measured from the upper region of the strike face to the intersection plane; wherein the clearance angle of the strike face is between 5° and 35°; forming a cavity in the rear portion of the body by means of hot-pressing; bending the strike face to a final angle, by means of forging, into a substantially planar surface arranged for impacting a golf ball, to form the golf club head having a cavity; and wherein the final angle is 90°.

Clause 2: The method of manufacturing the golf club head of clause 1, wherein the golf club head comprises a sole, a top rail, a strike face, a back wall of the strike face, a toe end, a heel end, and a rear portion; wherein the rear portion of the body has an upper edge and a nonlinear outer periphery; wherein the strike face has a heel end, a toe end, an upper region, and a lower region; wherein the upper region and lower region of the strike face are divided by an intersection plane; wherein the intersection plane is perpendicular to the lower region of the strike face.

Clause 3: The method of manufacturing the golf club head of clause 1, wherein the intersection plane is perpendicular to the lower region of the strike face and the strike plane.

Clause 4: The method of manufacturing the golf club head of clause 1, wherein the intersection plane intersects the golf club head at approximately 40-50% of a height of the club head; wherein the height of the club head is measured from the sole of the golf club head to the top rail of the golf club head.

Clause 5: The method of manufacturing the golf club head of clause 1, wherein the cavity formed by the hot-pressing stage comprises a volume ranging between 0.2 $in^3$ and 0.4 $in^3$.

Clause 6: The method of manufacturing the golf club head of clause 1, further comprising: fixing an insert within the cavity.

Clause 7: The method of manufacturing the golf club head of clause 6, wherein the insert can be fixed within the cavity via adhesion, press-fitting, mechanical fastening, or any other suitable methods of securing the insert.

Clause 8: The method of manufacturing the golf club head of clause 7, wherein a percentage of the cavity that is occupied by the insert ranges between 95%-100%.

Clause 9: The method of manufacturing the golf club head of clause 1, wherein the golf club head comprises a loft angle between 19° and 60°

Clause 10: The method of manufacturing the golf club head of clause 1, wherein the billet does not monolithically encase any other material.

Clause 11: The method of manufacturing the golf club head of clause 2, wherein the cavity of the golf club head extends in a direction from the heel end to the toe end.

Clause 12: The method of manufacturing the golf club head of clause 2, wherein the cavity formed by the hot-pressing stage further comprises a cavity axis; wherein the cavity axis passes through a nadir of the cavity; wherein the cavity axis exactly bisects the cavity and is equidistant from the cavity interior surface walls.

Clause 13: The method of manufacturing the golf club head of clause 12, wherein the cavity formed by the hot-pressing stage further comprises a press angle; wherein the press angle is measured from the cavity axis to the intersection plane.

Clause 14: The method of manufacturing the golf club head of clause 12, wherein the press angle ranges between 60°-90°.

Clause 15: The method of manufacturing the golf club head of clause 1, wherein the cavity formed by the hot-pressing stage further comprises a substantially triangular, rectangular, square, semi-circular, parabolic, or trapezoidal cross section.

Clause 16: The method of manufacturing the golf club head of clause 6, wherein the insert that is fixed within the cavity comprises a mass ranging between 1.0 g and approximately 30.0 g.

Clause 17: The method of manufacturing the golf club head of clause 16, wherein the insert that is fixed within the cavity comprises a density ranging between 1.0 g/cc and approximately 20.0 g/cc.

Clause 18: The method of manufacturing the golf club head of clause 10, wherein the billet comprises one or more of the following metals: 8620 alloy steel, S25C steel, carbon steel, maraging steel, stainless steel, stainless steel alloy, tungsten, aluminum, aluminum alloy, or any metal suitable for forging.

Clause 19: The method of manufacturing the golf club head of clause 10, wherein the billet comprises two or more of the following metals: 8620 alloy steel, S25C steel, carbon steel, maraging steel, stainless steel, stainless steel alloy, tungsten, aluminum, aluminum alloy, or any metal suitable for forging.

Clause 20: The method of manufacturing the golf club head of claim 10, wherein the billet comprises two or more metals, wherein at least one of the metals is 8620 alloy steel and at least one of the metals is tungsten.

What is claimed is:

1. A method of manufacturing a golf club head, the method comprising:

providing a billet of at least one material;

forming the billet into an intermediate club head body by means of forging, wherein the intermediate club head body comprises:

a sole, a top rail, a strike face, a back wall of the strike face, and a rear portion;

wherein the rear portion of the intermediate club head body has an upper edge and a nonlinear outer periphery;

wherein the strike face comprises an upper region, and a lower region;

wherein the upper region and lower region of the strike face are divided by an intersection plane;

wherein the intersection plane is perpendicular to the lower region of the strike face;

wherein the strike face is formed at a clearance angle;

wherein the clearance angle is measured from the upper region of the strike face to the intersection plane;

wherein the clearance angle of the strike face is between 5° and 35°;

forming a cavity in the rear portion of the intermediate club head body by means of hot-pressing; and bending the strike face to a final angle, by means of forging, into a planar surface arranged for impacting a golf ball, to form the golf club head having the cavity;

wherein the final angle is 90°.

2. The method of manufacturing the golf club head of claim 1, wherein the golf club head comprises a sole, a top rail, a strike face, a back wall of the strike face, a toe end, a heel end, and a rear portion;

wherein the rear portion of the intermediate club head body has an upper edge and a nonlinear outer periphery;

wherein the strike face has a heel end, a toe end, an upper region, and a lower region;

wherein the upper region and lower region of the strike face are divided by an intersection plane;

wherein the intersection plane is perpendicular to the lower region of the strike face.

3. The method of manufacturing the golf club head of claim 2, wherein the cavity formed by hot-pressing further comprises a cavity axis;

wherein the cavity axis passes through a nadir of the cavity;

wherein the cavity axis exactly bisects the cavity and is equidistant from interior surface walls of the cavity.

4. The method of manufacturing the golf club head of claim 1, wherein the intersection plane intersects the golf club head at 40-50% of a height of the golf club head; wherein the height of the golf club head is measured from the sole of the golf club head to the top rail of the gold club head.

5. The method of manufacturing the golf club head of claim 4, wherein the press angle ranges between 60°-90°.

6. The method of manufacturing the golf club head of claim 2, wherein the cavity of the golf club head extends in a direction from the heel end to the toe end.

7. The method of manufacturing the golf club head of claim 1, further comprising:

fixing an insert within the cavity.

8. The method of manufacturing the golf club head of claim 7, wherein the insert can be fixed within the cavity via adhesion, press-fitting, mechanical fastening, or any other suitable methods of securing the insert.

9. The method of manufacturing the golf club head of claim 8, wherein a percentage of the cavity that is occupied by the insert ranges between 95%-100%.

10. The method of manufacturing the golf club head of claim 7, wherein the insert that is fixed within the cavity comprises a mass ranging between 1.0 g and 30.0 g.

11. The method of manufacturing the golf club head of claim 10, wherein the insert that is fixed within the cavity comprises a density ranging between 1.0 g/cc and 20.0 g/cc.

12. The method of manufacturing the golf club head of claim 1, wherein the billet does not monolithically encase any other material.

13. The method of manufacturing the golf club head of claim 12, wherein the billet comprises one or more of the following metals: 8620 alloy steel, S25C steel, carbon steel, maraging steel, stainless steel, stainless steel alloy, tungsten, aluminum, aluminum alloy, or any metal suitable for forging.

14. The method of manufacturing the golf club head of claim 12, wherein the billet comprises two or more of the following metals: 8620 alloy steel, S25C steel, carbon steel, maraging steel, stainless steel, stainless steel alloy, tungsten, aluminum, aluminum alloy, or any metal suitable for forging.

15. The method of manufacturing the golf club head of claim 12, wherein the billet comprises two or more metals, wherein at least one of the metals is 8620 alloy steel and at least one of the metals is tungsten.

16. The method of manufacturing the golf club head of claim 1, wherein the intersection plane is perpendicular to the lower region of the strike face and the planar surface.

17. The method of manufacturing the golf club head of claim 1, wherein the intersection plane intersects the golf club head at 40-50% of a height of the club head;

wherein the height of the club head is measured from the sole of the golf club head to the top rail of the golf club head.

18. The method of manufacturing the golf club head of claim 1, wherein the cavity formed by hot-pressing comprises a volume ranging between 0.2 $in^3$ and 0.4 $in^3$.

19. The method of manufacturing the golf club head of claim 1, wherein the golf club head comprises a loft angle between 19° and 60°.

20. The method of manufacturing the golf club head of claim 1, wherein the cavity formed by hot-pressing further comprises a substantially triangular, rectangular, square, semi-circular, parabolic, or trapezoidal cross section.

* * * * *